US010710139B2

(12) United States Patent
Yuan et al.

(10) Patent No.: US 10,710,139 B2
(45) Date of Patent: Jul. 14, 2020

(54) METHOD FOR QUICK GAS BULGING FORMING OF HOT METAL SHEET

(71) Applicant: HARBIN INSTITUTE OF TECHNOLOGY, Harbin (CN)

(72) Inventors: Shijian Yuan, Harbin (CN); Zhubin He, Harbin (CN); Xiaobo Fan, Harbin (CN); Mingqu Ding, Harbin (CN); Guofeng Han, Harbin (CN)

(73) Assignee: Harbin Institute of Technology, Harbin (CN)

( * ) Notice: Subject to any disclaimer, the term of this patent is extended or adjusted under 35 U.S.C. 154(b) by 0 days.

(21) Appl. No.: 16/541,583

(22) Filed: Aug. 15, 2019

(65) Prior Publication Data

US 2019/0366409 A1 Dec. 5, 2019

Related U.S. Application Data

(63) Continuation of application No. 15/982,042, filed on May 17, 2018.

(30) Foreign Application Priority Data

Aug. 23, 2017 (CN) ..... 2017 1 0731644

(51) Int. Cl.

| | |
|---|---|
| ***B21D 26/027*** | (2011.01) |
| ***B21D 26/025*** | (2011.01) |
| ***B21D 26/055*** | (2011.01) |
| ***B21D 37/16*** | (2006.01) |
| *B21D 53/04* | (2006.01) |
| *B21D 26/029* | (2011.01) |

(52) U.S. Cl.

CPC ..... *B21D 26/027* (2013.01); *B21D 26/025* (2013.01); *B21D 37/16* (2013.01); *B21D 26/029* (2013.01); *B21D 26/055* (2013.01); *B21D 53/045* (2013.01)

(58) Field of Classification Search

CPC .. B21D 26/027; B21D 26/029; B21D 26/025; B21D 26/031; B21D 26/02; B21D 26/021; B21D 26/055

See application file for complete search history.

(56) References Cited

U.S. PATENT DOCUMENTS 2,728,317 A * 12/1955 Clevenger ..... B21D 26/02 72/60
4,250,727 A * 2/1981 Baril ..... B21D 22/201 148/691

(Continued)

*Primary Examiner* — Gregory D Swiatocha
(74) *Attorney, Agent, or Firm* — Avant Law Group, LLC

(57) ABSTRACT

A method for quick forming of a metal sheet. In an embodiment, the method includes the following steps: placing a metal sheet blank to be formed on a forming mold; introducing high-pressure gases with equal pressures simultaneously into upper and lower enclosed cavities respectively formed by the metal sheet blank and the sealing mold, and the metal sheet blank and the forming mold; heating the metal sheet blank to a preset forming temperature condition; quickly releasing the high-pressure gas from the cavity formed by the metal sheet blank and the forming mold, such that the metal sheet blank bulges; and discharging the gas from the cavity formed by the metal sheet blank and the sealing mold, and opening the mold to obtain a formed metal sheet part.

10 Claims, 12 Drawing Sheets

(56) References Cited

U.S. PATENT DOCUMENTS

| | | | | | |
|---|---|---|---|---|---|
| 5,085,068 | A * | 2/1992 | Rhoades | B21D 26/02 | 72/54 |
| 5,419,170 | A * | 5/1995 | Sanders | B21D 26/055 | 29/421.1 |
| 5,649,438 | A * | 7/1997 | Hall, Jr. | B21D 26/02 | 72/60 |
| 5,749,254 | A * | 5/1998 | Hall, Jr. | B21D 22/12 | 72/60 |
| 6,257,866 | B1 * | 7/2001 | Fritz | B29C 51/06 | 425/387.1 |
| 6,615,631 | B2 * | 9/2003 | Kleber | B21D 26/055 | 72/427 |
| 7,049,548 | B1 * | 5/2006 | Sjogren | B21D 26/021 | 219/385 |
| 7,431,196 | B2 * | 10/2008 | Eilert | B29C 43/10 | 228/181 |
| 2007/0063385 | A1 * | 3/2007 | Carsley | B21D 26/055 | 264/324 |

* cited by examiner

METHOD FOR QUICK GAS BULGING FORMING OF HOT METAL SHEET

This application claims priority to Chinese application number 201710731644.1, filed 23 Aug. 2017, with a title of METHOD FOR QUICK GAS BULGING FORMING OF HOT METAL SHEET. The above-mentioned patent application is incorporated herein by reference in its entirety.

TECHNICAL FIELD

The present invention relates to a technology for forming a metal sheet part, and in particular to a method capable of realizing quick gas bulging forming of a hot metal sheet.

BACKGROUND

The manufacture of a metal sheet member is mainly achieved by plastically deforming a blank via an externally applied load, depending on the plastic deformation capability of a metal material. For different metal materials, different forming processes and forming conditions should be adopted.

Since an aluminum alloy, a magnesium alloy, a titanium alloy, and the like materials have low density and high specific strength, and a part of the same mass made from them can provide higher carrying capacity, such a material is referred to as a lightweight material. A common disadvantage of such materials is poor plasticity at room temperature, making it difficult for the materials to manufacture a complex part at room temperature. Currently, a hot forming method is mainly adopted for shaping such materials. That is, a blank to be shaped is heated to an appropriate temperature and then shaped. According to different deformation speeds of the material during forming, the hot forming can be divided into a slow type and a quick type. For example, superplastic forming is a typical slow forming, and high-pressure gas bulging forming is a typical quick forming. The superplastic forming utilizes a relatively low gas pressure (typically lower than 10 atmospheres, i.e., 1.0 MPa) to deform a blank under a high-temperature at a very slow rate, typically at a strain rate lower than $10^{-2}$/s. Since a person cannot operate in a high-temperature environment, or a part is stuck to a mold under a high temperature, it should remove the part only after the mold and the part are cooled to a lower temperature upon forming. Therefore, it often takes several hours or even longer to superplastic form a single part. This disadvantage significantly limits application of the superplastic forming in mass production. High-pressure gas bulging forming is achieved by increasing the gas pressure (for example, reaching 10 MPa or even higher) to deform the blank in a relatively short period of time. Since the entire process of the high-pressure gas bulging forming is very quick and the forming cycle of a single part requires only tens of seconds or even shorter, the high-pressure gas bulging forming becomes an advanced technology for mass production using the aforementioned lightweight metal materials. During the high-pressure gas bulging forming, currently a sheet blank is deformed mainly by quickly inflating the cavity of a mold through inflation holes partially disposed on the mold. Since during gas bulging forming both the sheet blank and the mold are at a relatively high temperature, while the introduced gas is in a state of room temperature and high pressure, the temperature of a local region on the blank will be significantly reduced to form a non-uniform temperature field due to the air flow and pressure drop during the inflation process. For a part having a simple shape such as an axisymmetric cylindrical part, the inflation hole often just faces the central position of the sheet blank, such that it can be substantially ensured that the part is deformed in a symmetrical manner. However, for a complicated metal sheet part, if the position of the inflation hole is not set properly, an unreasonable temperature field distribution will be formed on the sheet blank. On the other hand, since the gas is introduced into an enclosed space formed by the sheet blank and the mold cavity through the locally-positioned inflation holes during quick inflation, there may be a certain degree of non-uniformity in the gas pressure within a short period of inflation. Deformation of the metal sheet blank is co-determined by the temperature distribution on the sheet blank and the gas pressure acting on the sheet blank. When the temperature distribution and pressure distribution are unreasonable, it will be difficult to obtain the desired final part.

In order to realize precise and quick forming of a thin-walled metal sheet part having a relatively thin wall thickness and a complex shape, it is necessary to develop a forming technology which can ensure that the blank is deformed under a reasonable temperature condition and a reasonable gas-pressure condition.

SUMMARY

An objective of the present invention is to solve the problem that the existing hot metal sheet forming technology cannot ensure that a blank is deformed under reasonable temperature and pressure conditions, thereby failing to realize precise and quick forming of a complex metal sheet part, especially a thin-walled part. Therefore, a method for quick gas bulging forming of a hot metal sheet is further provided.

The method for quick gas bulging forming of a hot metal sheet is implemented according to the following steps:

step one, placing a metal sheet blank to be formed on a forming mold, and closing a sealing mold to form enclosed cavities on upper and lower surfaces of a metal sheet blank;

step two, introducing high-pressure gases with equal pressures simultaneously into upper and lower enclosed cavities respectively formed by the metal sheet blank and the sealing mold, and the metal sheet blank and the forming mold;

step three, heating the metal sheet blank to a preset forming temperature condition;

step four, quickly releasing the high-pressure gas from the enclosed cavity formed by the metal sheet blank and the forming mold, such that the metal sheet blank bulges quickly under the action of the high-pressure gas at the other side and thus fits into the mold cavity of the forming mold; and step five, discharging the gas from the cavity formed by the metal sheet blank and the sealing mold, and opening the sealing mold to obtain a formed metal sheet part.

The beneficial effects of the present invention are:

(1) the inflation process is independent and controllable: high-pressure gases on both sides of the metal sheet blank are introduced at the same time, and since the gas pressures on both sides of the sheet blank are maintained equal or substantially equal, the upper and lower surfaces of the metal sheet blank are in an equilibrium state and thus will not be deformed due to bulging (see FIGS. 4-8), thereby avoiding the problem that during conventional gas bulging forming conducted by directly introducing a high-pressure gas (see FIGS. 1-4), the increase in gas pressure and the deformation of the sheet blank occur at the same time and are changed in a complicated manner (see FIG. 9), which leads to the situation that it is difficult to effectively control the deformation process;

(2) the inflation process is conducted in advance: after the metal sheet blank is placed into the mold and the mold is closed to achieve sealing, high-pressure gases can be immediately introduced into cavities on both sides of the sheet blank (see FIG. 6), without waiting for adjusting the temperature of the sheet blank to a specific state, or without considering the possible effect of the introduction of high-pressure gases on the temperature of the sheet blank, and thus the entire inflation pressurizing process can be completed in a very short time (see FIG. 10);

(3) the temperature of the sheet blank is not affected: at the time of gas bulging forming, the blank is already under a reasonable temperature condition (the temperature on the sheet blank can be either isothermally or non-isothermally distributed), and during forming no external gas is directly blown onto the sheet blank to change the temperature condition, thereby avoiding the problem that the conventional direct introducing of high-pressure gases may cause an unreasonable temperature change on the sheet blank and thus affect the bulging deformation of the sheet blank;

(4) the quick forming performance is excellent: when bulging deformation occurs, the gas between the sheet blank and the forming mold is quickly discharged in a short time, and a certain numerical pressure difference will be quickly formed between two sides of the sheet blank, and when the numerical value of the pressure difference is large, the metal sheet blank will bulge in a very short time (see FIGS. 8 and 10); due to the quick deformation speed and high strain rate, the forming performance of the metal sheet under such conditions is generally higher, thus providing a basis for forming a complex part, especially a part with a larger local strain;

(5) the distribution of pressure difference is controllable: during gas bulging forming the gas pressure in the cavity between the sealing mold and the metal sheet blank is maintained uniform or substantially uniform, and the numerical value of the gas pressure does not change significantly during the gas bulging forming process; on the other side of the sheet blank, different pressure distributions can be formed on the lower surface of the sheet blank by opening vent holes at different positions on the forming mold and controlling the deflation speeds at the different positions (see FIGS. 11, 16 and 17); in other words, a non-uniform pressure difference distribution may be formed on the sheet blank by controlling the deflation position and speed, which provides the possibility of controlling the deformation at various places on the blank during formation of a complex metal part;

(6) the temperature distribution during forming is controllable: the heating of the metal sheet blank can be done by either preheating it outside the mold before putting it into the mold, or heating it through a hot mold after it is placed into the mold, or heating can be done directly by connecting a power electrode at both ends of the sheet blank; in practice, different heating methods can also be combined to obtain a required specific temperature distribution condition; since the inflation process is completed before the temperature adjustment, and the formation of pressure difference on the sheet blank through quick deflation is completed in a very short time, this indicates the temperature distribution condition on the metal sheet blank during the gas bulging forming is stable, which provides the possibility for reasonably using the temperature distribution to obtain the required bulging deformation;

(7) the forming accuracy is high: since the gas bulging forming of the metal sheet blank is completed in a few seconds or even shorter time, and the time period since the bulging start of the metal sheet blank to complete fit of it into the mold is very short, the temperature of the sheet blank will not be significantly decreased due to contact with the forming mold, and thus the adopted forming mold may be at a warm state or even a state of room temperature, which means that the shape and dimensional accuracy of the final part is completely determined by the forming mold, thereby avoiding the problem that the conventional use of a hot mold may affect the dimensional accuracy of the mold cavity due to thermal expansion and contraction; and (8) the forming efficiency is high: since the inflation pressurizing process and the deflation pressure-difference building process are both completed in a very short time, this solves the problem that during the conventional quick gas bulging forming the inflation speed is forced to be reduced for avoiding the possible adverse effect of quick inflation pressurizing on the temperature distribution and pressure distribution on the sheet blank, and thus can achieve quick gas bulging forming of a complicated part.

Figure 9:
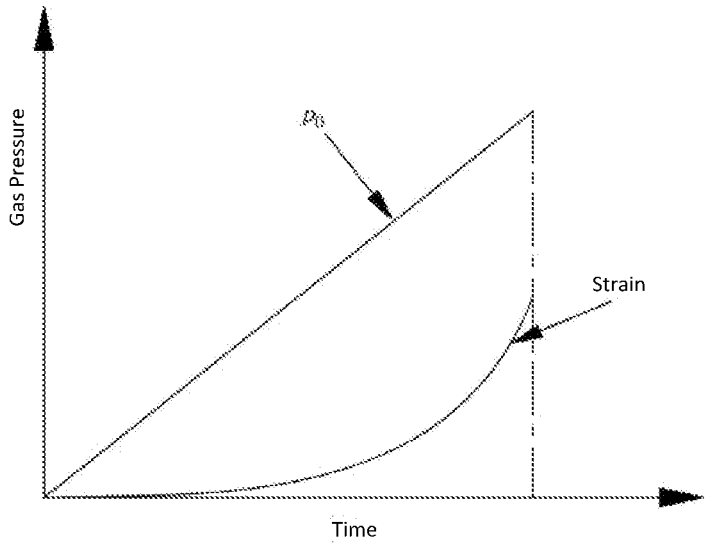
FIG. 9 PRIOR ART
Figure 10:
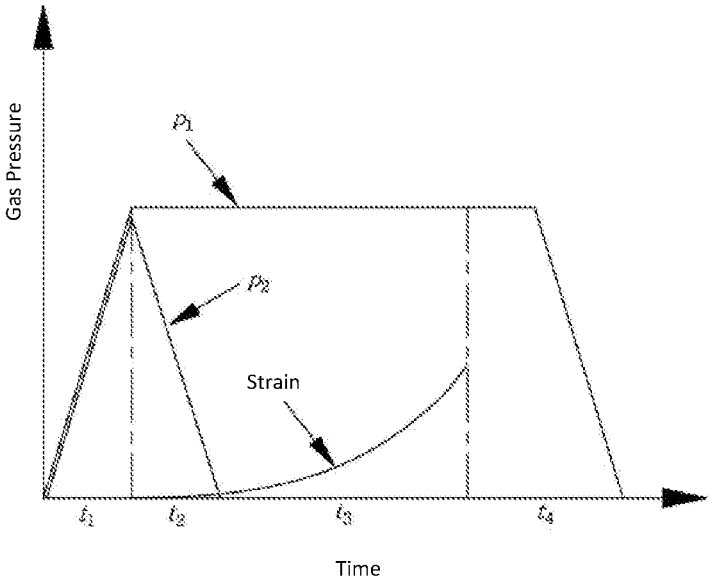
Figure 11:
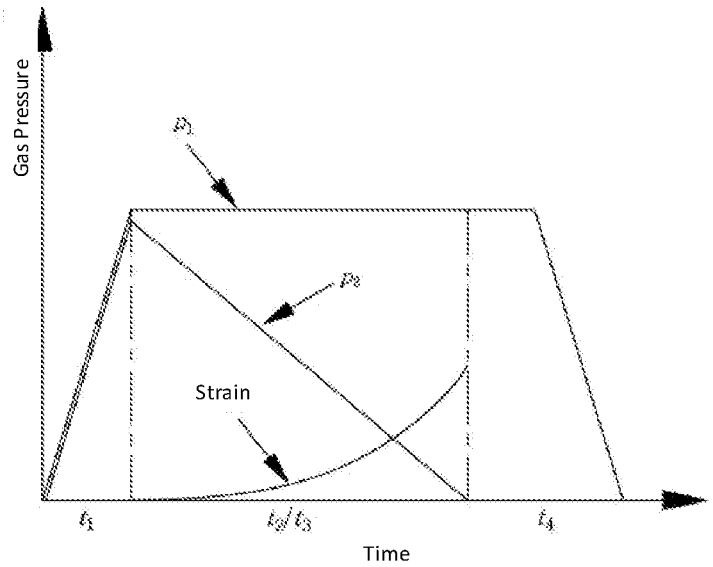
Figure 12:
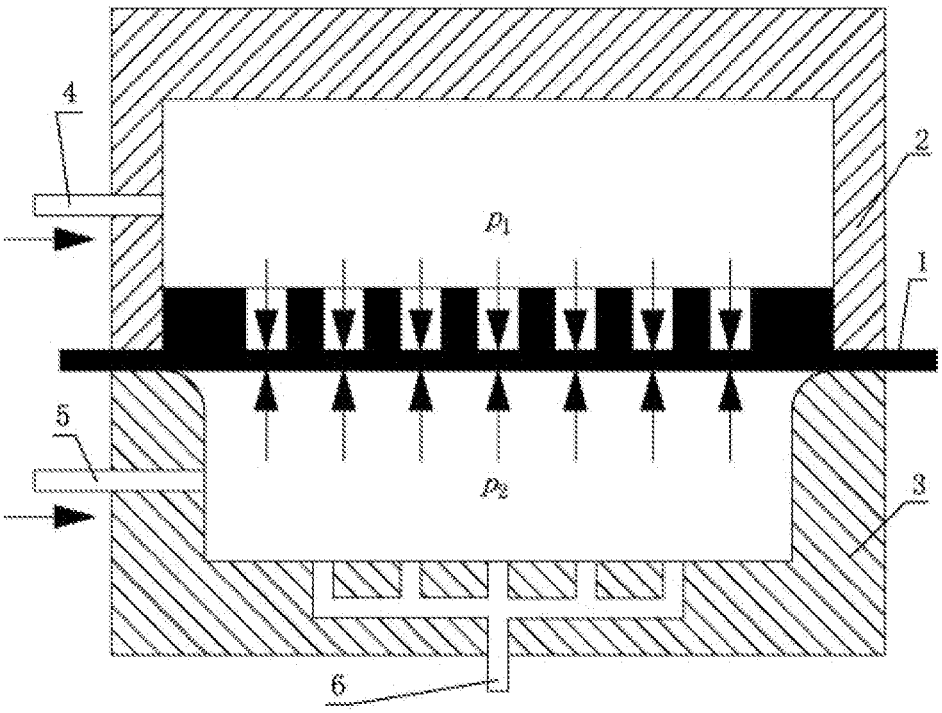
Figure 13:
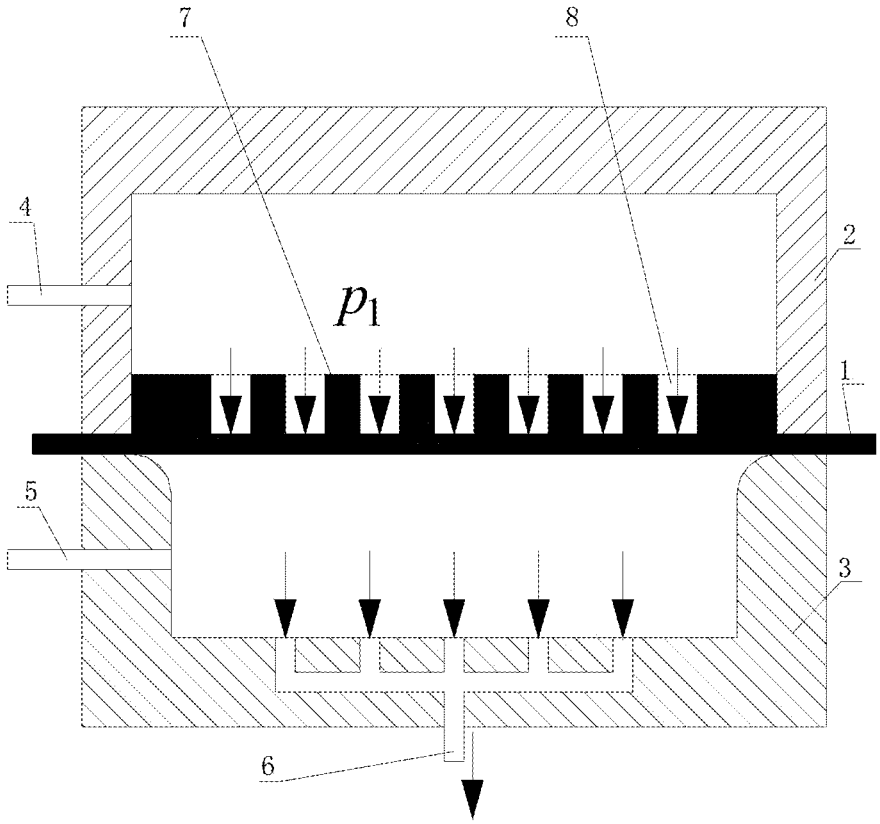
Figure 14:
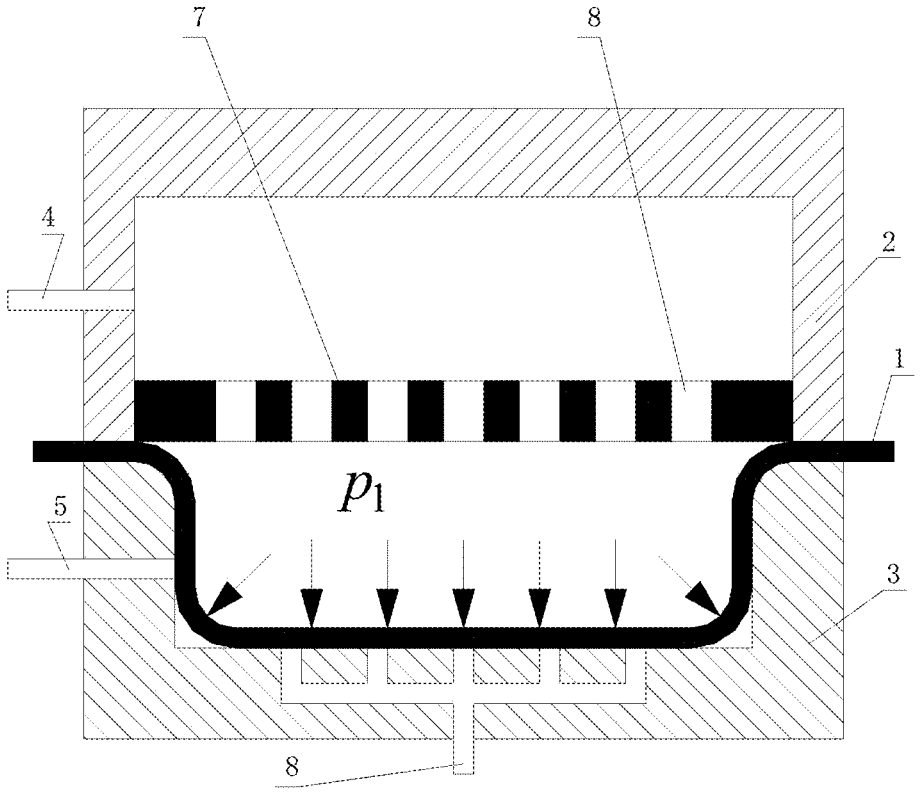
Figure 15:
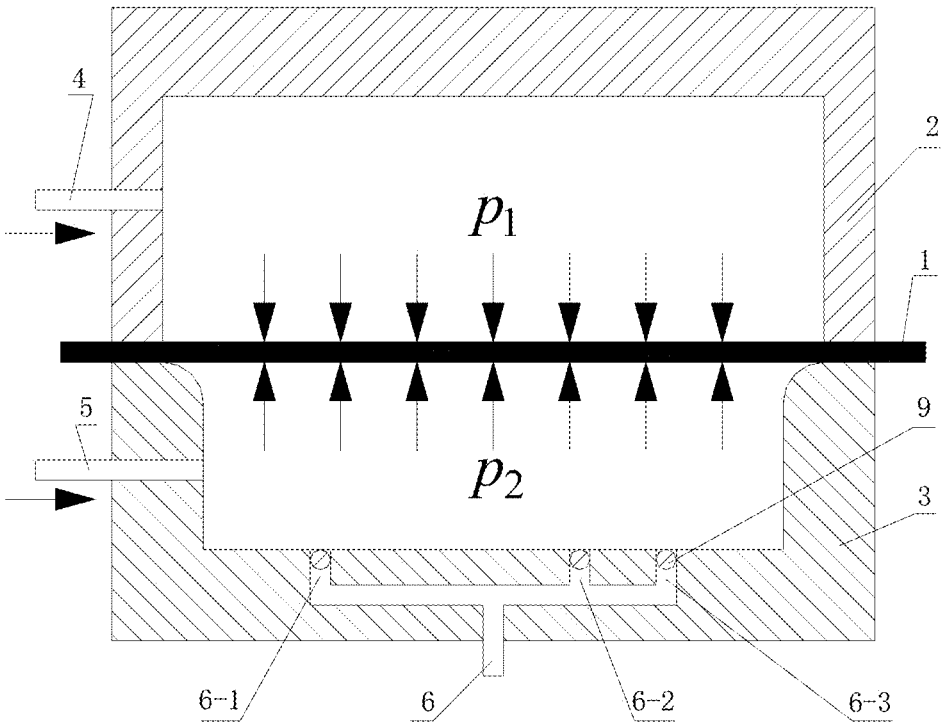
Figure 16:
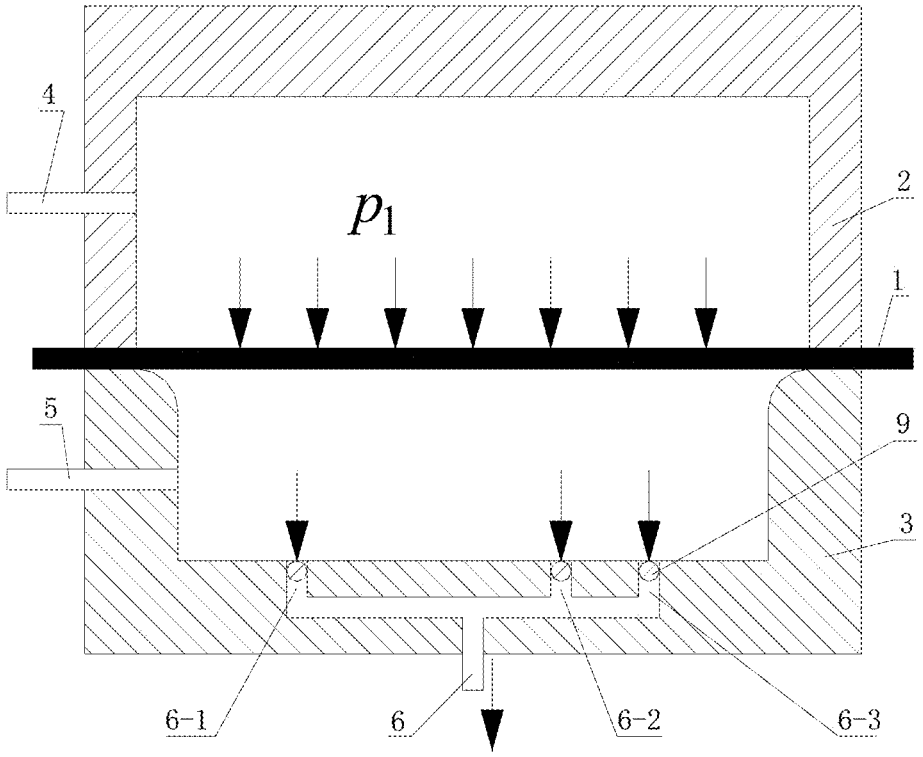
Figure 17:
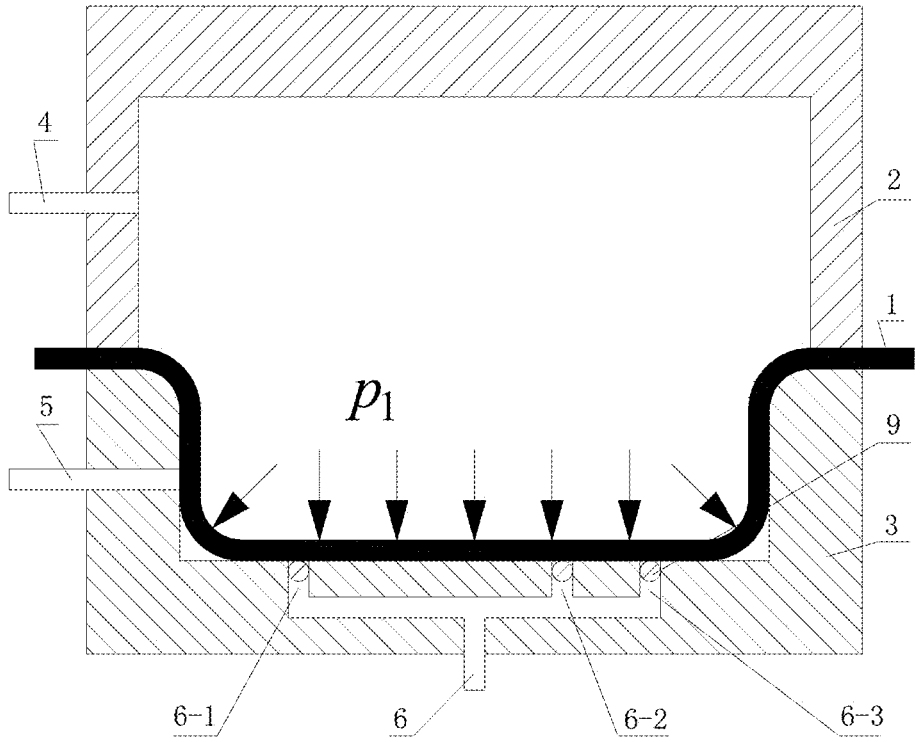
Figure 18:
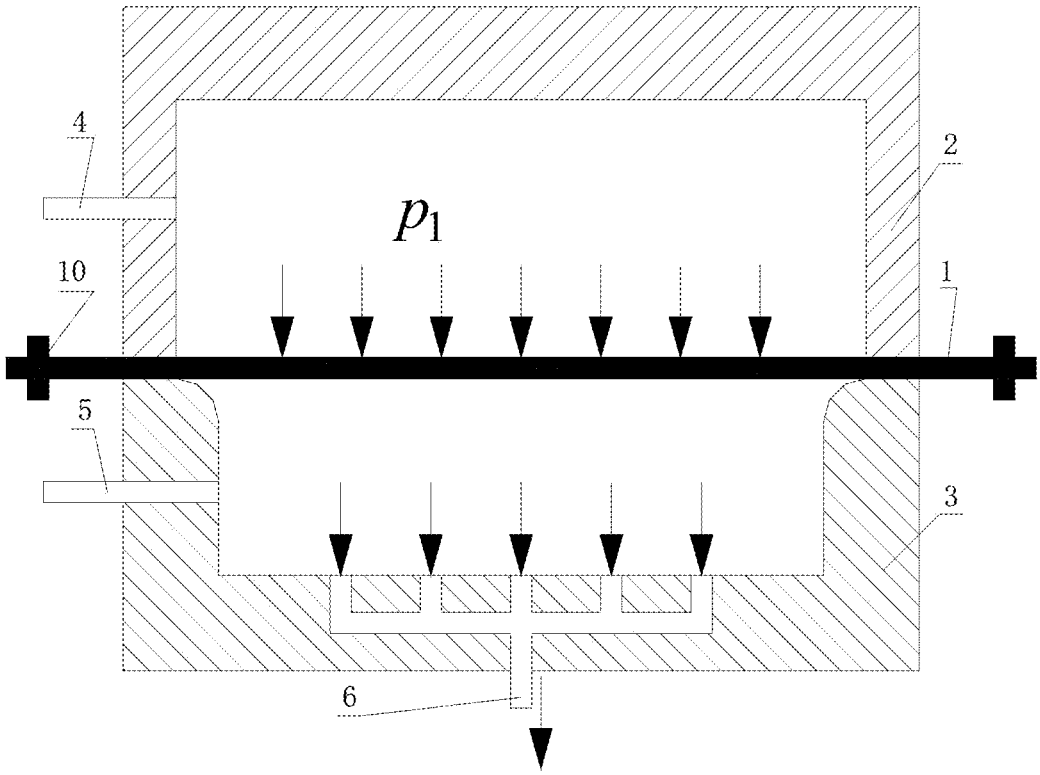
Figure 19:
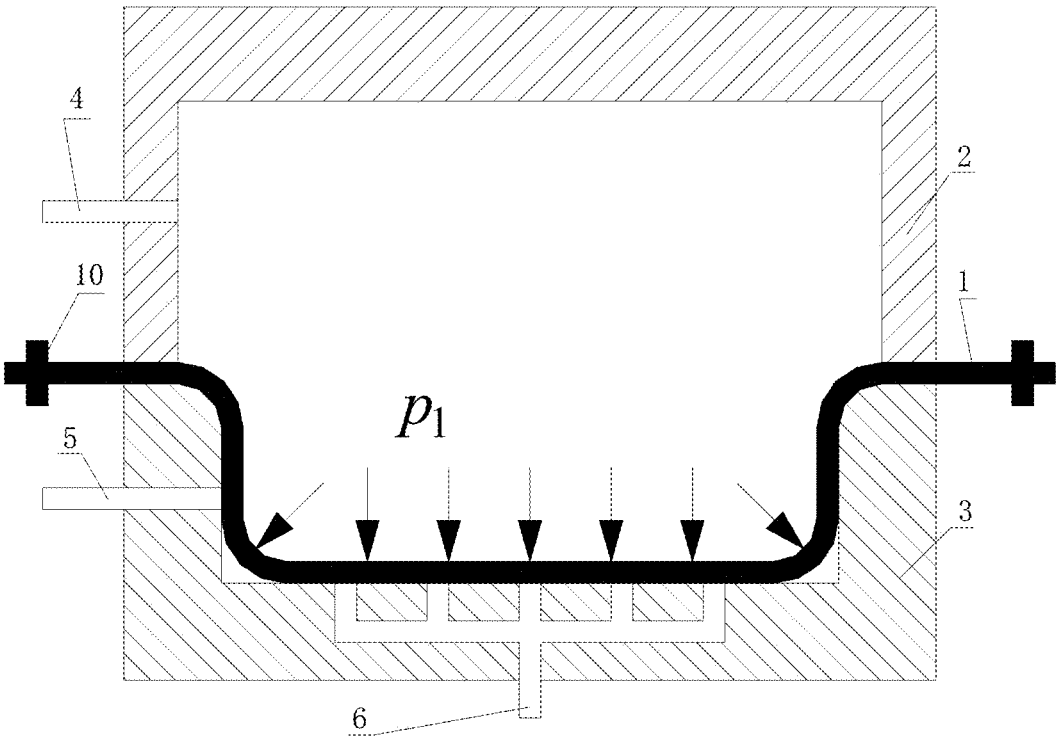
Figure 20:
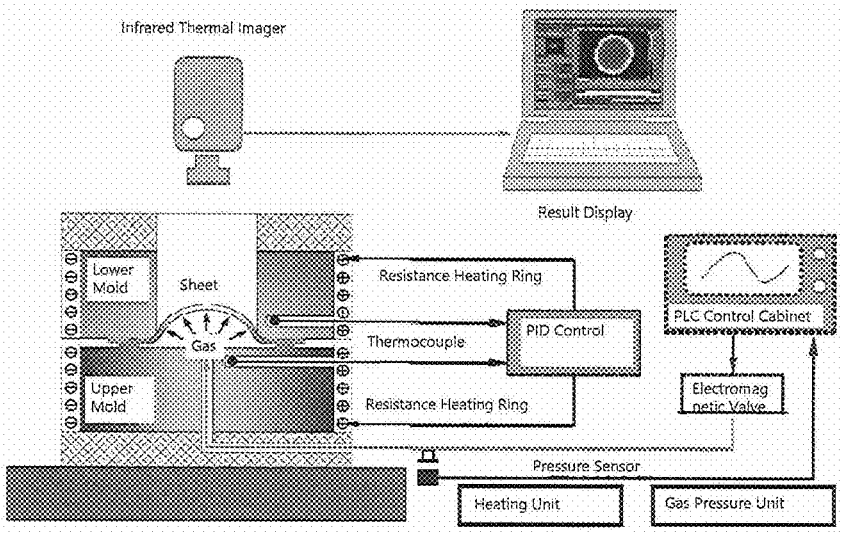
Figure 21:
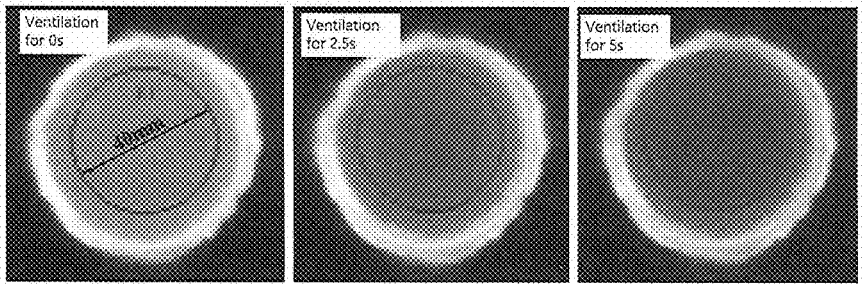
Figure 22:
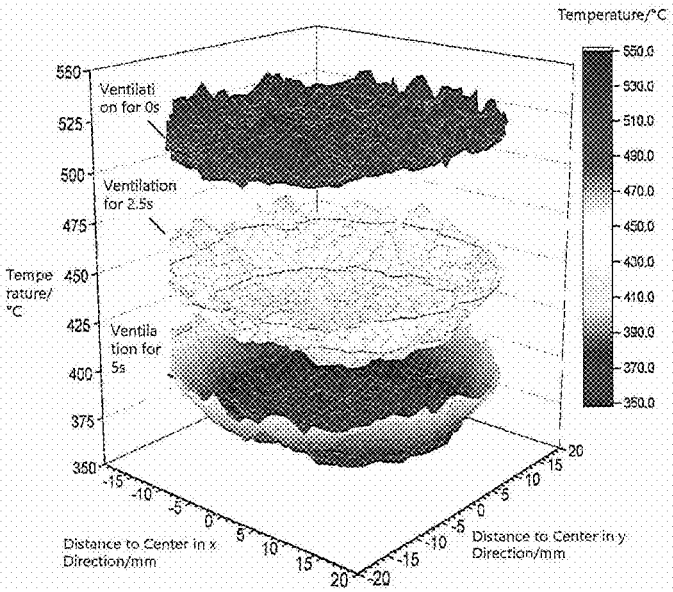
Figure 23:
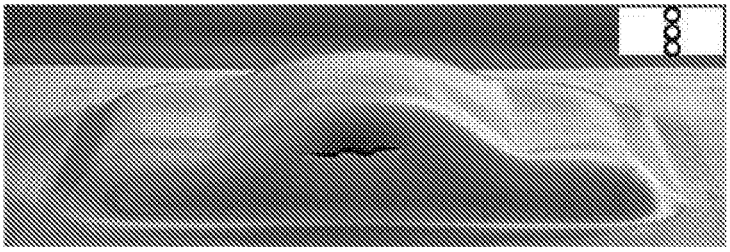
FIG. 23 PRIOR ART
Figure 24:
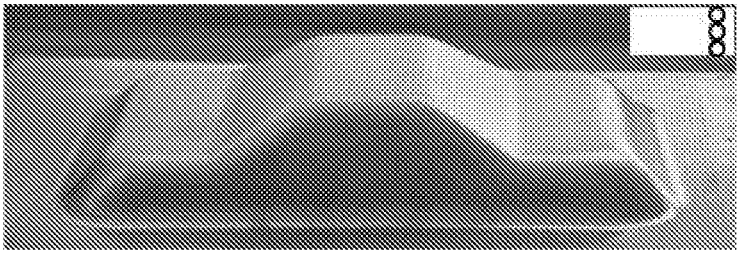

wherein, 1 refers to a metal sheet blank, 2 refers to a sealing mold, 3 refers to a gas bulging forming mold, 4 refers to an inflation hole of the sealing mold, 5 refers to an inflation hole of the gas bulging forming mold, and 6 refers to a vent hole of the gas bulging forming mold;

FIG. 9 is a schematic diagram showing the changes of gas pressure and strain in conventional direct gas bulging forming, wherein t is a time used for the conventional direct gas bulging forming process, P0 is a pressure for direct inflation, the unit of time is second, and the unit of pressure is MPa;

FIG. 10 is a schematic diagram showing the changes of the gas pressure and the strain of the metal sheet blank during the quick deflation in the solution adopted by the present invention;

FIG. 11 is a schematic diagram showing the changes of the gas pressure and the strain of the metal sheet blank during control of deflation speed in the solution adopted by the present invention;

wherein, t1 is a time used for gas pressurization (inflation) in the solution adopted by the present invention, t2 is a time used for quickly decreasing the gas pressure on the back face of the metal sheet blank (deflation), t3 is a bulging time after the gas pressure on the back face of the metal sheet blank is completely eliminated, t4 is a time used for holding and releasing the pressure after the metal sheet blank bulges and fits in to the mold, P1 is a gas pressure in the cavity formed by the sealing mold and the metal sheet blank, and P2 is a gas pressure in the cavity formed by the gas bulging forming mold and the metal sheet blank, wherein the unit for time is second, and the unit for pressure is MPa;

FIG. 12 is a schematic diagram of heating the metal sheet blank by using a hot steel plate after inflation in Embodiment 2 of the present invention;

FIG. 13 is a schematic diagram of quick deflation of FIG. 12;

FIG. 14 is a schematic diagram of quick bulging of FIG. 13;

FIG. 15 is a schematic diagram of arranging multiple vent holes at the bottom of a forming mold for realizing controllable deflation in Embodiment 3 of the present invention;

FIG. 16 is a schematic diagram of arranging a gas regulating valve on a vent hole for controlling a deflation speed in Embodiment 4 of the present invention;

FIG. 17 is a schematic diagram of quick bulging when gas regulating valves are arranged on multiple vent holes;

FIG. 18 is a schematic diagram of conducting quick heating of a metal sheet blank by using a power electrode when a room-temperature forming mold and a sealing mold are adopted in Embodiment 5 of the present invention;

FIG. 19 is a schematic diagram of bulging of the metal sheet blank after being quickly heated by the power electrode in FIG. 18;

wherein, 7 refers to a hot steel plate, 8 refers to a vent hole, 9 refers to a gas regulating valve, and 10 refers to a power electrode;

FIG. 20 is a schematic diagram of an apparatus for measuring the temperature distribution of the metal sheet blank;

FIG. 21 is a state diagram showing the temperature change after ventilation is continued for 5 s when a circular region with a diameter of 40 mm on the metal sheet blank is used as a measuring region;

FIG. 22 is a schematic diagram showing the temperature measurement of the circular region of the metal sheet blank and the measured results;

FIG. 23 is a schematic diagram in which local quick ventilation at the middle portion causes fracture of the metal sheet blank; and FIG. 24 is a schematic diagram in which unilateral quick ventilation causes a poor mold fitting effect at one side.

DETAILED DESCRIPTION

The technical solutions of the present invention will be further described below through the detailed description in connection with the accompanying drawings.

Embodiment 1: as illustrated referring to FIGS. 5 to 8 and 10, the method for quick forming of a hot metal sheet is realized according to the following steps:

step one, placing a metal sheet blank 1 to be formed on a forming mold 3, and closing a sealing mold 2 to form enclosed cavities on upper and lower surfaces of the metal sheet blank 1;

step two, introducing high-pressure gases with equal pressures simultaneously into upper and lower enclosed cavities respectively formed by the metal sheet blank 1 and the sealing mold 2, and the metal sheet blank 1 and the forming mold 3 through an upper inflation hole 4 and a lower inflation hole 5;

step three, heating the metal sheet blank 1 to a preset forming temperature condition;

step four, quickly releasing the high-pressure gas from the enclosed cavity formed by the metal sheet blank 1 and the forming mold 3 through the vent hole 6, such that the metal sheet blank 1 bulges quickly under the action of the high-pressure gas contained in the cavity formed by the metal sheet blank 1 and the sealing mold 2, and thus fits into the mold cavity of the forming mold 3; and step five, discharging the gas from the cavity formed by the metal sheet blank 1 and the sealing mold 2, and opening the sealing mold 2 to obtain a formed metal sheet part.

Figure 1:
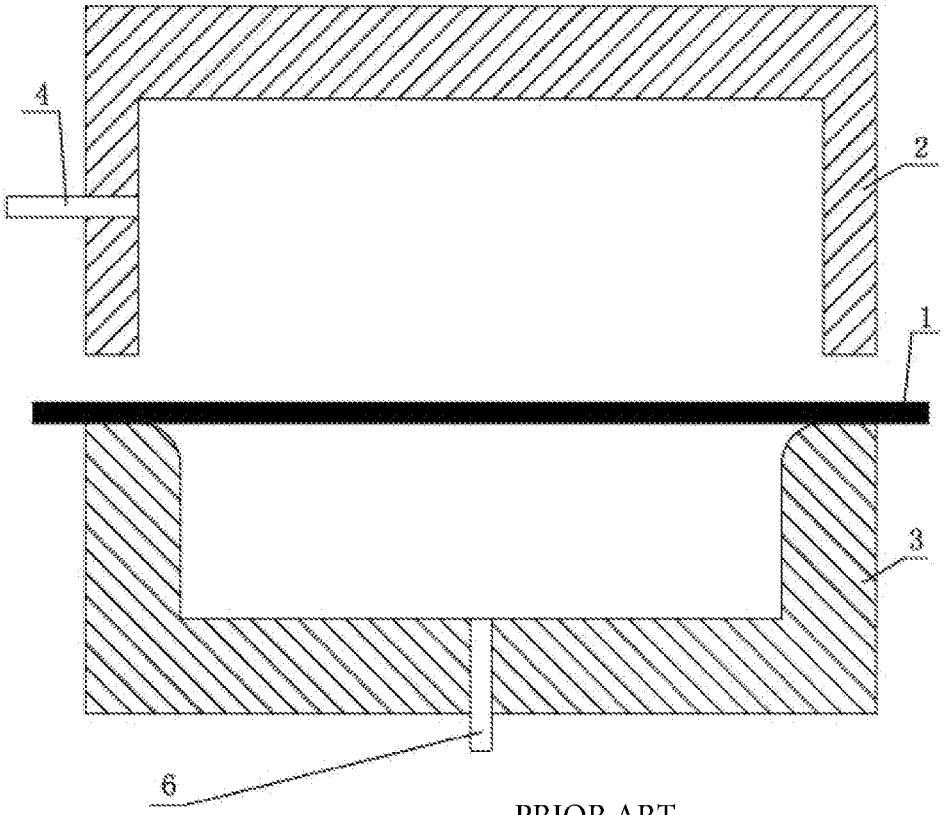
FIG. 1 PRIOR ART
FIG. 1 is a is a schematic diagram of blank placement in conventional direct gas bulging forming of sheet blank.
Figure 2:
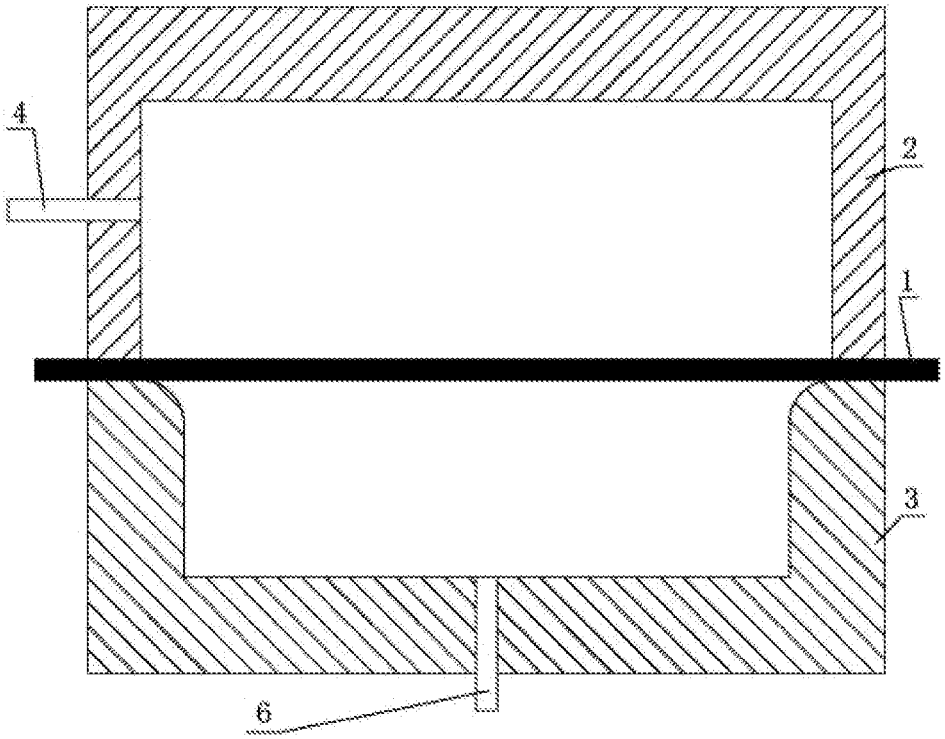
FIG. 2 PRIOR ART
FIG. 2 is a schematic diagram of mold sealing in conventional direct gas bulging forming of sheet blank.
Figure 3:
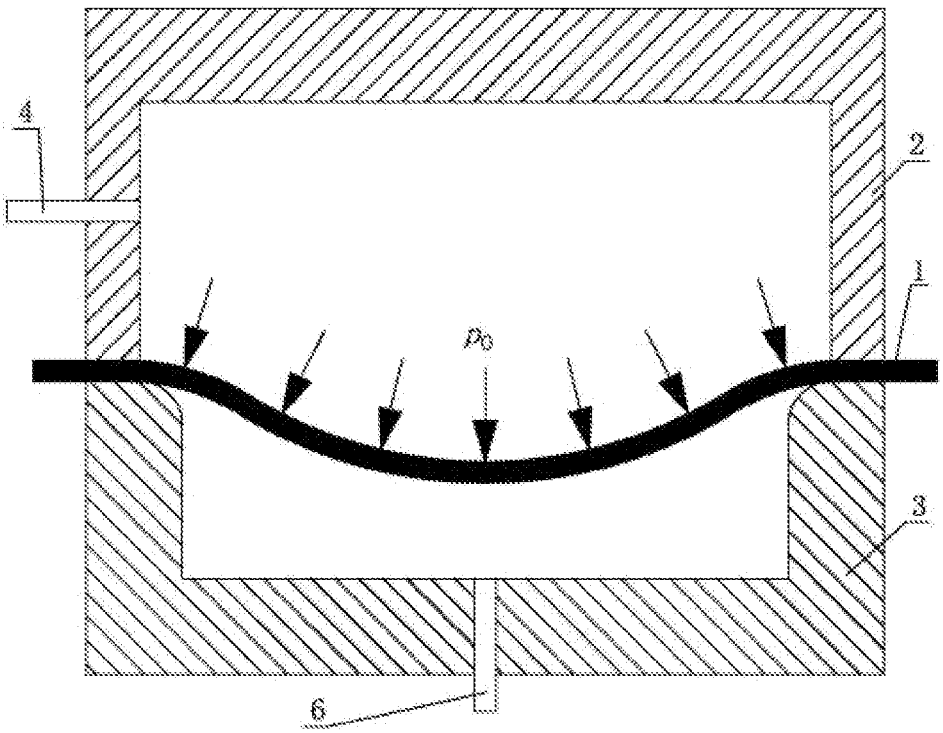
FIG. 3 PRIOR ART
FIG. 3 is a is a schematic diagram of bulging under a varied gas pressure in conventional direct gas bulging forming of sheet blank.
Figure 4:
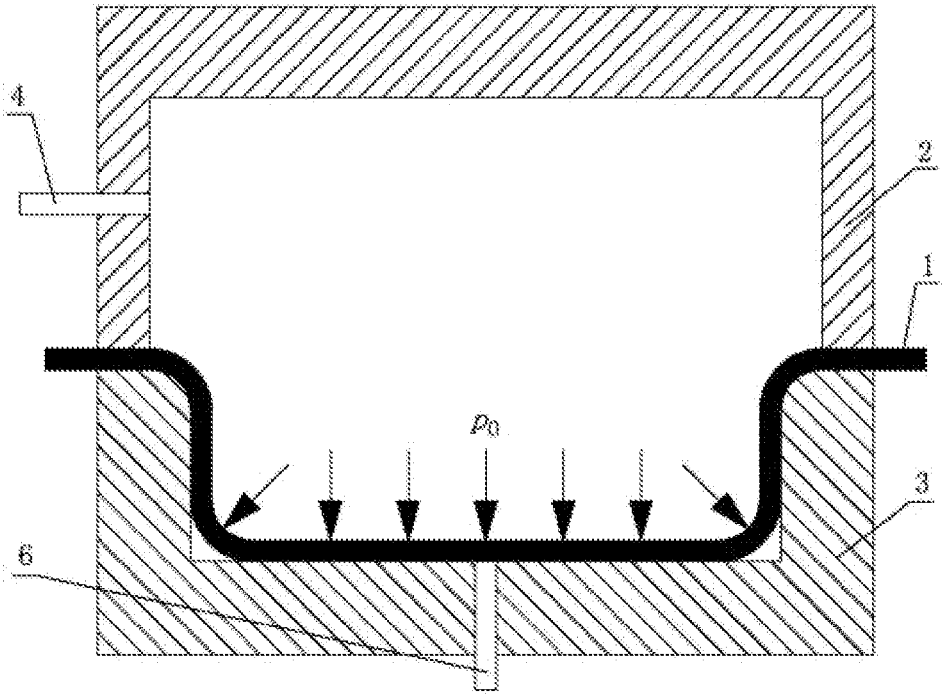
FIG. 4 PRIOR ART
FIG. 4 is a schematic diagram of ending of inflation bulging of conventional direct gas bulging forming of sheet blank.
Figure 5:
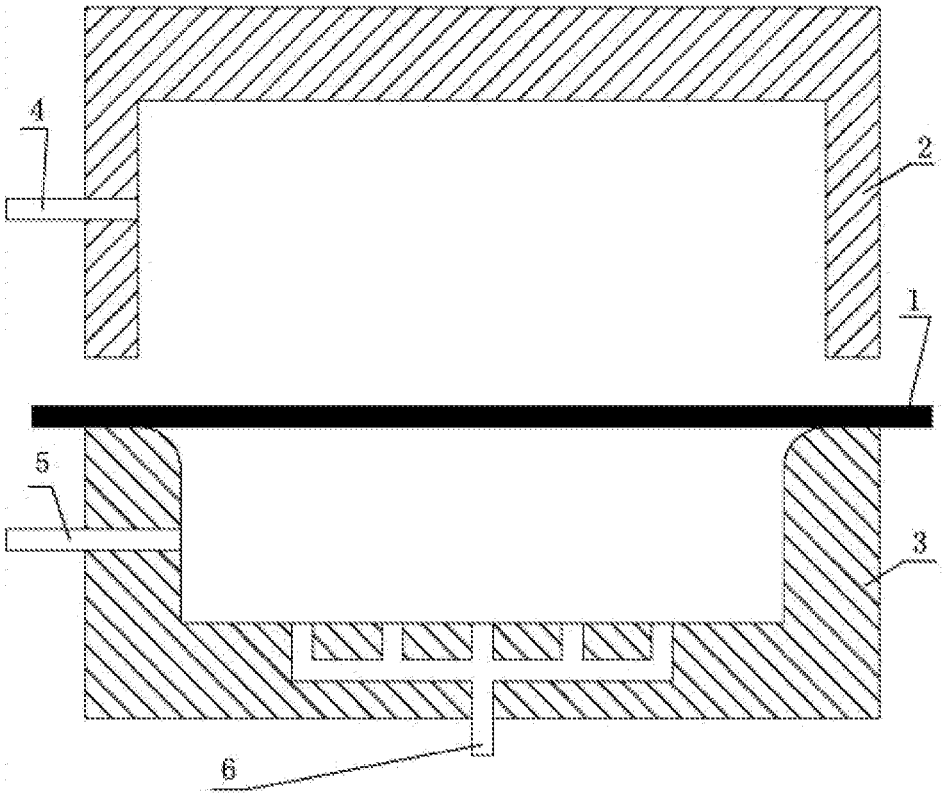
FIG. 5 is a schematic diagram of blank placement in quick hot metal gas bulging forming of the present invention.
Figure 6:
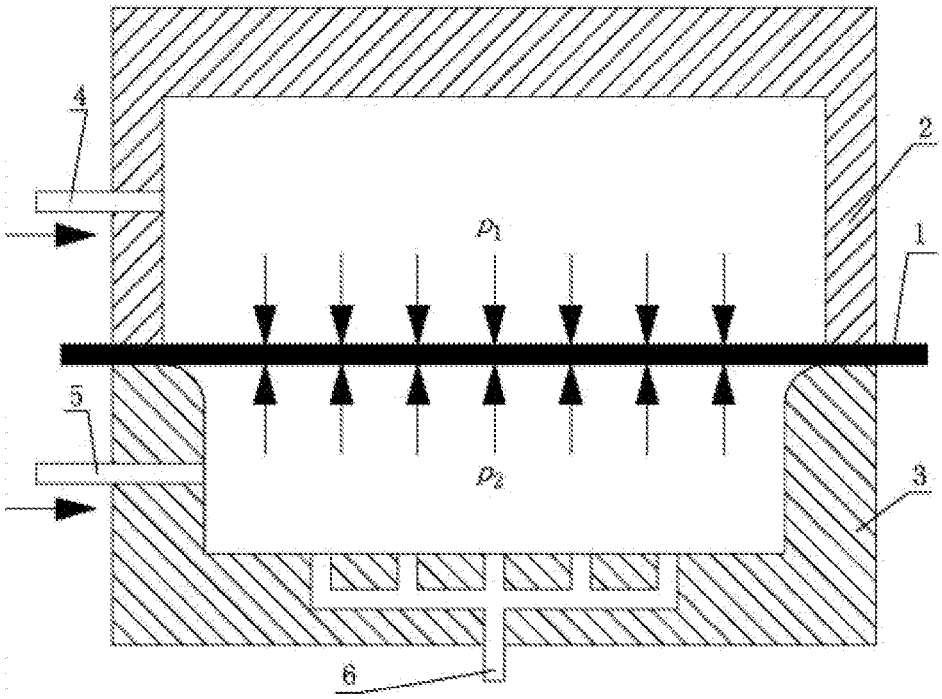
FIG. 6 is a schematic diagram of mold sealing and quick inflation in quick hot metal gas bulging forming of the present invention.
Figure 7:
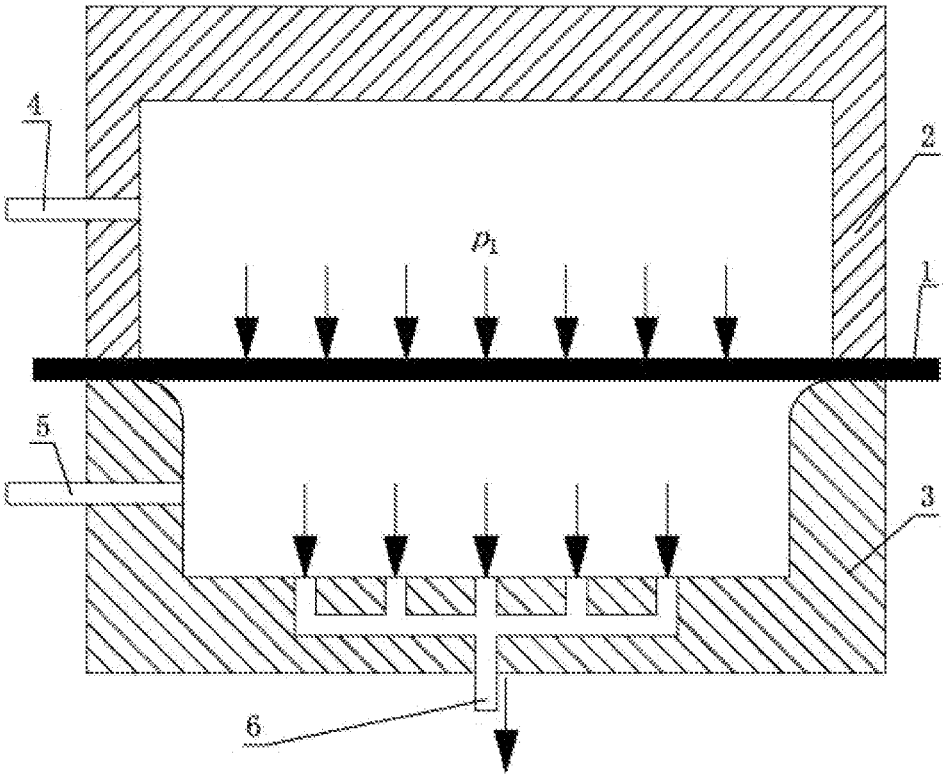
FIG. 7 is a schematic diagram of quick deflating in quick hot metal gas bulging forming of the present invention.
Figure 8:
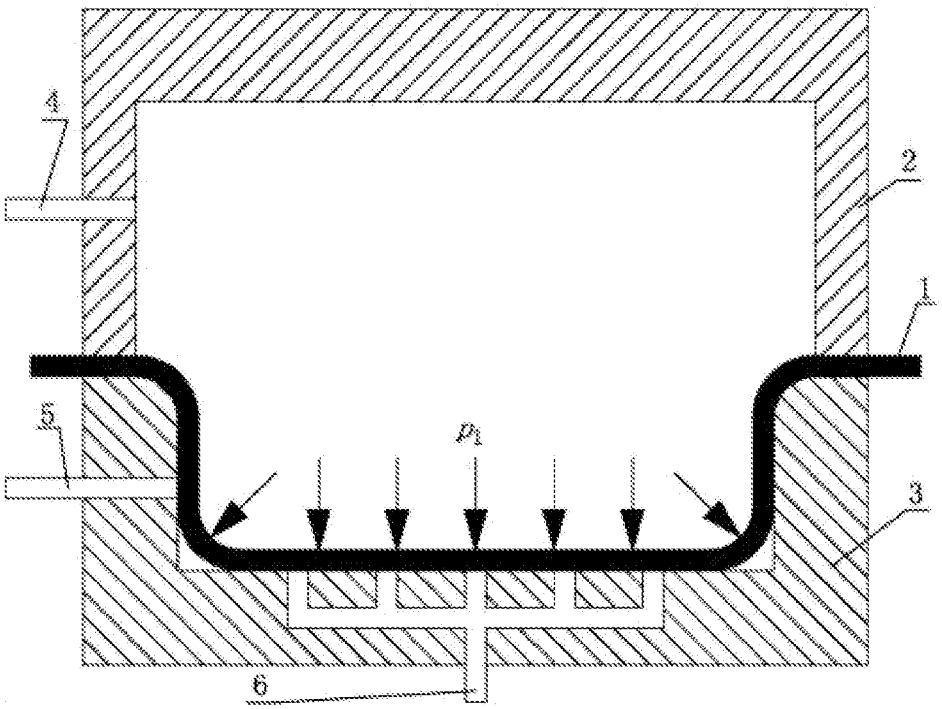
FIG. 8 is a schematic diagram of quick bulging under a constant gas pressure in quick hot metal gas bulging forming of the present invention.

In this embodiment, the high-pressure gases on the upper and lower sheet surfaces of the metal sheet blank are introduced at the same time and the gas pressure thereof are maintained equal or substantially equal, i.e., P1=P2, (see FIGS. 6 and 10). The upper and lower surfaces of the metal sheet blank 1 are in an equilibrium state, and thus will not be deformed due to bulging, thereby avoiding the problem that during conventional gas bulging forming conducted by directly introducing a high-pressure gas, simultaneous occur of gas inflation and deformation of the metal sheet blank causes that it is difficult to reasonably control the deformation process (in the bulging process shown in FIG. 3, the gas pressure P0 for direct inflation is varied, as shown in FIG. 9; and during the deflating and bulging processes of the present invention shown in FIGS. 7 and 8, the gas pressure P1 in the cavity formed by the metal sheet blank and the sealing mold is constant, as shown in FIGS. 10 and 11). After the metal sheet blank is placed into the sealing mold and the forming mold, and the molds are closed to achieve sealing, high-pressure gases can be immediately introduced into upper and lower cavities of the metal sheet blank, without waiting for adjusting the temperature of the metal sheet blank to a specific state, or without considering the possible effect of the introduction of high-pressure gases on the temperature of the metal sheet blank, and thus the entire inflation pressurizing process can be completed in a very short time.

Effect of gas pressure loading on the sheet temperature: during the hot quick gas bulging forming, a high-pressure gas is quickly introduced, and the gas is generally a high-pressure compressed gas at a temperature lower than room temperature. When the gas is filled quickly, it can easily affect the temperature of the hot sheet. FIG. 20 is a schematic diagram of an apparatus for measuring the sheet temperature distribution (simulation, deleted) by a FLIRSC325 infrared thermal imager with an emissivity of 0.3655, a reflection temperature of 20.0° C., a distance of 1.0 m, and an atmospheric temperature of 20.0° C.

FIG. 21 shows the temperature change on the sheet blank during continuous ventilation for 5 seconds. A circular area E1 with a diameter of 40 mm on the sheet is selected as the measuring area, and it can be seen from FIGS. 21 and 22 that as the ventilation continues (the ventilation time is 0-5 seconds), the sheet temperature is gradually decreased. The smaller the distance from the circular area to the center is, the greater the amplitude of temperature drop is. After ventilation is continued for 5 s, the temperature is reduced up to 160° C. On one hand, the quick decrease of the sheet temperature in the inflation process will lead to reduction of the forming performance of the local sheet, and on the other hand, the unreasonable temperature distribution in different regions of the sheet blank may cause complex uncoordinated deformation.

As shown in FIG. 23, during the quick gas bulging forming the quick ventilation is only conducted at the middle position of the sheet blank, and since the temperature of the central region which is in contact with the gas first is quickly reduced and the forming performance is reduced, a fracture defect occurs.

As shown in FIG. 24, during the quick gas bulging forming only unilateral quick ventilation occurs, and since the temperature of the area which is in contact with the gas first is decreased and the deformation resistance is increased, the mold fitting effect of the side which is inflated first (the left side in the figure) is poor.

Embodiment 2: as illustrated with reference to FIGS. 5 to 8, FIG. 10, and FIGS. 12 to 14, the difference between this embodiment and Embodiment 1 is that: in step three, the heating manner of the metal sheet blank is limited, such as heating outside the mold, heating by coming in contact with a steel plate, radiant heating the mold, and the like, and the metal sheet blank is either isothermal or non-isothermal. Particularly: in the first step, the used sealing mold 2 and the forming mold 3 are in a hot state, and the temperature thereof is T2. The metal sheet blank 1 has a predetermined forming temperature of T0. The metal sheet blank 1 has been preheated to a temperature T1 before being placed into the sealing mold 3 and the forming mold 2. When T1 is smaller than T0, T2>T0 is required to heat the metal sheet blank 1 again using the mold so as to reach the predetermined forming temperature T0. When the original metal sheet blank 1 is large in size and relatively distant from the mold cavity, a hot steel plate 7 may be additionally placed on the upper surface of the metal sheet blank 1, i.e., the cavity formed by the sealing mold 2 and the metal sheet blank 1. The temperature of the hot steel plate 7 is T3 and T3>T0. The hot steel plate 7 is placed as in parallel with the metal blank 1 and is in close proximity to or in direct contact with the metal blank, and the hot steel plate 7 is provided with a vent hole 8 thereon.

In this embodiment, the metal sheet blank 1 is heated in different manners in respect of different requirements for the forming temperature of the metal sheet blank 1. It not only can achieve an approximately uniform temperature distribution, but also can form a non-uniform temperature distribution on the metal sheet blank 1 by controlling the temperature distribution of the mold, the temperature distribution of the hot steel plate 7, and the like. This provides the possibility of effectively controlling the bulging deformation of the metal sheet blank 1 and thus obtaining a part with a complicated shape. The other steps are the same as those in Embodiment 1.

Embodiment 3: as illustrated with reference to FIGS. 5 to 8, FIG. 10, and FIGS. 15 to 17, the difference between this embodiment and Embodiment 1 or 2 is that: the arranging manner of vent holes is limited, and different arrangement manners are adopted for different parts. Particularly: in step four, multiple non-uniformly distributed vent holes 6 are opened at the bottom of the forming mold 3, a first vent hole 6-1 is located on the left side of the cavity, and a second vent hole 6-2 and a third vent hole 6-3 are located on the right side of the cavity.

In this embodiment, when the enclosed cavity of the forming mold 3 is a complex asymmetric structure, by reasonably setting the number and positions of the vent holes 6, the high-pressure gas contained in the enclosed cavity formed by the metal sheet blank 1 and the forming mold 3 can be quickly released to an atmospheric pressure at almost the same speed, such that an approximately uniform pressure difference can be quickly formed on the upper and lower surfaces of the metal sheet blank 1. The distance from the second vent hole 6-2 to the first vent hole 6-1 is relatively longer, the second vent hole 6-2 and the third vent hole 6-3 are arranged close to each other, and the metal sheet blank 1 will be expanded quickly under a sufficiently high gas pressure. The other steps are the same as those in Embodiment 1 or 2.

Embodiment 4: as illustrated with reference to FIGS. 5 to 8, FIG. 11, and FIGS. 15 to 17, the difference between this embodiment and one of Embodiments 1 to 3 is that: the speed and pressure value for the quick gas releasing are limited (different parts may require for different deflation speeds. There may always be a back pressure until the gas is completely released. Particularly: in step four, a gas regulating valve 9 is also provided on the multiple vent holes 6 opened at the bottom of the forming mold 3, and the deflation speed of each vent hole can be adjusted by the gas regulating valve 9.

In this embodiment, different gas pressure distributions will be generated in the cavity due to the rapid flow of high-pressure gas during quick deflation. By reasonably setting the number and positions of the vent holes 6 and adjusting the deflation speed of each vent hole, a non-uniform gas pressure will be formed in the cavity formed by the metal sheet blank 1 and the forming mold 3, such that different pressures will act on the lower surface of the metal sheet blank 1. Since the pressure on the upper surface of the metal sheet blank 1 is approximately uniform, the metal sheet blank 1 will be expanded quickly under the non-uniformly distributed pressure differential condition. By reasonably setting the non-uniformly distributed pressure difference, it is possible to reasonably control the deformation of different portions of the metal sheet blank 1 and thus to realize the formation of a part with a complicated shape. The other steps are the same as those in one of the Embodiments 1 to 3.

Embodiment 5: as illustrated with reference to FIGS. 5 to 8, FIG. 11, and FIG. 18, the difference between this embodiment and one of Embodiments 1 to 4 is that: a cold mold is used, and the heating manner of the metal sheet blank 1 is electric heating. Particularly: in steps one to five, both the sealing mold 2 and the forming mold 3 are at a temperature condition of room temperature, and the metal sheet blank 1 is also at room temperature before being placed into the mold. In step three, the metal sheet blank 1 is quickly heated by an electrode 10 provided thereon.

In this embodiment, the metal sheet blank 1, the sealing mold 2 and the forming mold 3 are all initially at the state of room temperature, and the removal, placing, transferring and the like of the metal sheet blank 1 can be realized by using conventional methods and apparatuses. In step two, there is no need to consider the possible effect of the inflation process on the temperature of the metal sheet blank 1, and in step three the heating of the metal sheet blank 1 can be completed within several seconds. Therefore, the inflation process and the heating process of the metal sheet blank 1 are independent from each other without causing mutual interference. This greatly simplifies the removal and placing of the blank and shortens the adjustment and control time of the mold temperature. Moreover, since the cavity of the forming mold 3 at room temperature is the shape of the final part, the problem of affecting the accuracy of the mold due to thermal expansion and contraction when the hot mold is used is avoided. This also provides the possibility of forming a part with a high requirement in precision. The other steps are the same as those in one of the Embodiments 1 to 4.

What is claimed is:

1. A method for gas bulging forming of a hot metal sheet, wherein the method is implemented according to the following steps:

step one, placing a metal sheet blank to be formed on a forming mold, and closing a sealing mold to form enclosed cavities on upper and lower surfaces of the metal sheet blank;

step two, introducing high-pressure gases with equal pressures simultaneously into upper and lower enclosed cavities respectively formed by the metal sheet blank and the sealing mold, and the metal sheet blank and the forming mold;

step three, heating the metal sheet blank to a preset forming temperature condition;

step four, quickly releasing the high-pressure gas from the enclosed cavity formed by the metal sheet blank and the forming mold, such that the metal sheet blank bulges quickly under the action of the high-pressure gas in the upper cavity and thus fits into the mold cavity of the forming mold; and step five, discharging the gas from the cavity formed by the metal sheet blank and the sealing mold, and opening the sealing mold to obtain a formed metal sheet part.

2. The method of claim 1, wherein the heating of the metal sheet blank in step three is conducted through contact heating using a hot steel plate.

3. The method of claim 2, wherein in step four, multiple non-uniformly distributed vent holes are opened at the bottom of the forming mold, a first vent hole is located on the left side of the lower cavity, and a second vent hole and a third vent hole are located on the right side of the lower cavity.

4. The method of claim 3, wherein in step four, a gas regulating valve is further provided on the multiple vent holes opened at the bottom of the forming mold, and a deflation speed of each vent hole can be adjusted by the respective gas regulating valve.

5. The method of claim 1, wherein in step four, multiple non-uniformly distributed vent holes are opened at the bottom of the forming mold, a first vent hole is located on the left side of the lower cavity, and a second vent hole and a third vent hole are located on the right side of the lower cavity.

6. The method of claim 5, wherein in step four, a gas regulating valve is further provided on the multiple vent holes opened at the bottom of the forming mold, and a deflation speed of each vent hole can be adjusted by the respective gas regulating valve.

7. The method of claim 6, wherein in steps one to five, both the sealing mold and the forming mold are at a temperature condition of room temperature, and the metal sheet blank is also at room temperature before being placed on the forming mold, and in step three, the metal sheet blank is quickly heated by an electrode provided thereon.

8. The method of claim 1, wherein in steps one to five, both the sealing mold and the forming mold are at a temperature condition of room temperature, and the metal sheet blank is also at room temperature before being placed on the forming mold, and in step three, the metal sheet blank is quickly heated by an electrode provided thereon.

9. The method of claim 1, wherein a pressure in the enclosed cavity on the lower surface has a linearly increasing phase corresponding to step two and a linearly decreasing phase corresponding to step four, the linearly decreasing phase occurring immediately after the linearly increasing phase.

10. A method for gas bulging forming of a hot metal sheet, wherein the method is implemented according to the following steps:

step one, placing a metal sheet blank to be formed on a forming mold, and closing a sealing mold to form enclosed cavities on upper and lower surfaces of the metal sheet blank;

step two, introducing high-pressure gases with equal pressures simultaneously into upper and lower enclosed cavities respectively formed by the metal sheet blank and the sealing mold, and the metal sheet blank and the forming mold;

step three, heating the metal sheet blank to a preset forming temperature condition;

step four, quickly releasing the high-pressure gas from the enclosed cavity formed by the metal sheet blank and the forming mold, such that the metal sheet blank bulges quickly under the action of the high-pressure gas in the upper cavity and thus fits into the mold cavity of the forming mold; and step five, discharging the gas from the cavity formed by the metal sheet blank and the sealing mold, and opening the sealing mold to obtain a formed metal sheet part;

wherein:

step four is completed in less than 5 seconds; and the high-pressure gas has a pressure of at least 10 MPa.

* * * * *